US006719604B2

(12) United States Patent
Chan

(10) Patent No.: US 6,719,604 B2
(45) Date of Patent: Apr. 13, 2004

(54) INTERACTIVE DRESS-UP TOY

(75) Inventor: Albert Wei Tai Chan, Hong Kong (CN)

(73) Assignee: Thinking Technology, Inc., Nassau (BS)

( * ) Notice: Subject to any disclaimer, the term of this patent is extended or adjusted under 35 U.S.C. 154(b) by 21 days.

(21) Appl. No.: 09/752,558

(22) Filed: Jan. 3, 2001

(65) Prior Publication Data

US 2002/0061700 A1 May 23, 2002

Related U.S. Application Data

(60) Provisional application No. 60/174,715, filed on Jan. 6, 2000, and provisional application No. 60/200,377, filed on Apr. 28, 2000.

(51) Int. Cl.[7] ..... A63H 3/00

(52) U.S. Cl. ..... 446/297; 446/484

(58) Field of Search ..... 446/97, 98, 268, 446/175, 297, 305, 304, 298, 299, 300, 301, 302, 303, 484

(56) References Cited

U.S. PATENT DOCUMENTS 5,037,345 A * 8/1991 Nakayama ..... 446/297
5,158,492 A * 10/1992 Rudell et al. ..... 446/175
5,290,198 A * 3/1994 Nakayama ..... 446/297
5,607,336 A * 3/1997 Lebensfeld et al. ..... 446/297
5,959,281 A * 9/1999 Domiteaux ..... 235/454
6,171,168 B1 * 1/2001 Jassop ..... 446/297
6,554,679 B1 * 4/2003 Shackelford et al.

FOREIGN PATENT DOCUMENTS

FR 2297066 * 5/1975

* cited by examiner

*Primary Examiner*—Jacob K. Ackun
(74) *Attorney, Agent, or Firm*—Kramer & Amado, P.C.; Gordon J. Zimmerman, Esq.

(57) ABSTRACT

An interactive dress-up toy comprises removable clothing and accessories, sensor means to detect the specific item of clothing or the specific accessory worn by the toy, and communication means to communicate to the user the status of the clothing and accessories worn by the toy or missing from the toy. The sensor means may be adapted to detect a form of electromagnetic energy, and to detect the specific item of clothing worn by the toy. The material of the clothing is selected to be reflective or non-reflective of the form of energy to be detected by the sensor means, and may be fitted with a material to selectively trigger the sensor means.

10 Claims, 10 Drawing Sheets

INTERACTIVE DRESS-UP TOY

This application claims the benefit of Provisional application Ser. Nos. 60/174,715, filed Jan. 6, 2000, and 60/200,377, filed Apr. 28, 2000.

BACKGROUND TO THE INVENTION

Toys and dolls which can be dressed-up by children have always been popular. It is a challenge to find new ways to make the combination of a doll or toy with its clothing or accessories more interesting or entertaining. Teaching children to dress dolls or toys appropriately is one of the uses of ensembles of dolls or toys and their clothing or accessories. It would thus be an advantage to be able to ensure that clothing or accessories to be held by or placed on the doll or toy are correctly positioned. In addition, it would be an advantage if the toy or doll could respond to the child once an article of clothing or an accessory has been placed on the doll or toy in order to indicate that the clothing is acceptable. In this way, an interactive relationship between the child and the doll or toy could be created. It would be a further advantage if multiple toys and dolls could communicate their status to each other, to create interactivity between multiple dolls or toys.

Toys and dolls are often sold along with, or separately from, sets of clothing and accessories intended to be used with such dolls or toys. It would be a great advantage to create a coding system so that different articles or sets of clothing could be recognized by a single doll or toy, or a variety of dolls or toys. The dolls or toys could be preprogrammed to recognize a variety of clothing or accessories, regardless of the particular clothing with which the dolls or toys were sold. This would facilitate flexibility of purchasing decisions and permit a great variety of clothing and accessories to be made available using the instant invention.

SUMMARY OF THE INVENTION

Accordingly, in a major aspect, an interactive dress-up toy comprises removable clothing and accessories; sensor means to detect the specific item of clothing or the specific accessory worn by the toy; and communication means to communicate to the user the status of the clothing and accessories worn by the toy or missing from the toy.

In further aspects of the invention:

(a) the communication means comprises artificial speech;

(b) the communication means comprises lights;

(c) the communication means comprises an electronic display screen;

(d) the sensor means comprises a master sensor and multiple secondary sensors;

(e) the secondary sensors comprise clothing sensors and accessories sensors;

(f) each clothing sensor comprises a light source and a light sensor;

(g) the light source and light sensor are mounted at a short distance from each other and angled such that when an article of clothing is worn by the toy, light emitted from the light source will reflect from a reflective surface on the interior of the article of clothing and be directed towards the light sensor to create a signal;

(h) an array of clothing sensors is coded to match an array of reflective patterns on various articles of clothing;

(i) each accessory sensor comprises a male portion and a female portion;

(j) the male portion comprises a pin of a selected length, namely long or short, and the female portion comprises a hole adapted to receive said pin, the hole ending with a contact plate or switch adapted to be contacted by a long pin;

(k) an array of female portions is coded to match an array of male portions to correspond with various accessories;

(l) an integrated circuit receives signals from one or more secondary sensors to trigger appropriate communication signals to the user;

(m) the removable clothing and accessories comprises multiple sets of clothing and multiple sets of accessories corresponding to different activities.

In a secondary aspect of the invention, an interactive toy comprises at least one removable element; sensor means to detect the presence or absence of the removable element or elements; and communication means to communicate to the user the status of the element or elements present or absent from the toy.

In further aspects of the secondary aspect of the invention:

(a) the communication means comprises artificial speech;

(b) the communication means comprises lights;

(c) the communication means comprises at least one electronic display screen;

(d) the sensor means comprises a source of electromagnetic radiation and a detector of electromagnetic radiation;

(e) the sensor means comprises a source of magnetic fields and a detector of magnetic fields;

(f) the sensor means comprises a source of magnetic interference and a detector of magnetism;

(g) the electromagnetic radiation is of infrared frequency;

(h) the electromagnetic radiation is of radio frequency;

(i) the electromagnetic radiation is of visible light frequency;

(j) the status of the element or elements or its or their presence or absence from the toy corresponds to a set of one or more stored audible messages relating to said status;

(k) the status of the clothing corresponds to the presence or absence of a particular activity or personality;

(l) the status of the clothing triggers the communication means to produce audible signals appropriate to said status chosen from a set of signals appropriate to all possible clothing statuses;

(m) the status of the accessory corresponds to the presence or absence of a particular activity or personality;

(n) the status of the accessory triggers the communication means to produce audible signals appropriate to said status chosen from a set of signals appropriate to all possible accessory statuses.

In a further aspect of the invention, one doll or toy comprising sensor means and communication means as aforesaid, further comprises transmission and receiving means such that said doll or toy can communicate its status to other dolls or toys, and vice and generate appropriate audible comments accordingly.

In the doll of the preferred embodiment, several light sources and sensors are mounted at or below the surface of the doll or toy. In order to be able to code the articles of clothing, a light signal is adapted to be reflected only from specific areas of the clothing. It is important to have a sensor which is sensitive enough to ensure that a signal will be created when clothing is properly positioned. Overly high sensitivity, however, may render the sensor subject to unwanted signals.

A doll's clothing is typically made of cloth. Black cloth is generally non-reflective to light, such as infrared light, while white cloth is generally reflective of such light. Nonetheless, different materials exhibit different reflectivities depending upon factors such as their colour, physical construction (including the density of the weave), chemical structure, cleaning agents used on the material, and wear (for example, crushing of the material in use or storage). Under certain circumstances, even nearly black material may reflect infrared signals. Thus, errors in recognition of the particular clothing worn by the doll can arise. It is important to improve the reliability of the system comprising the doll or toy and the clothing by clearly differentiating reflective areas from non-reflective areas of the clothing. To achieve this differentiation, one can use special areas of reflective material and/or material which is a good reflector of the particular light source chosen, and special non-reflective areas and/or material which is a very good non-reflector. Coloured plastic can also be used to make reflective or non-reflective sections of clothing. Cloth fibres may be natural, such as wool, cotton or silk; or synthetic, such as polyester, polyethylene, nylon, etc.

Non-reflective areas may be composed, for example, of black felt sewn or glued to the inside of the doll's clothing. Felt has been found to be a good choice since it is dense and is unlikely to permit stray signals to pass through it. Other embodiments are also possible; for example, a black pigment printed onto the inside of the clothing or onto a patch fastened to the clothing may be very effective. By the same token, a reflective area may be comprised of white felt. Felt may be very good material to choose when appropriate since it is dense and reflective when coloured white. But other materials may function equally effectively when chosen appropriately. For example, black and dark blue linings appear almost equal in colour to the naked eye, yet can act as non-reflective and reflective surfaces respectively to disguise the function of the different materials from the user. This may be an advantage since it will increase interest when the user is intrigued by the doll's interactivity, yet is unable to determine how this interactivity has occurred.

Accordingly, in a further aspect, the invention comprises the combination of clothing and an interactive dress-up toy comprising: removable clothing; sensor means on the toy adapted to detect a form of electromagnetic energy, and further adapted to detect the specific item of clothing worn by the toy; and communication means to communicate to the user the status of the clothing worn by or missing from the toy; wherein the material of the clothing is selected to be reflective or non-reflective of the form of energy to be detected by the sensor means.

In further aspects of the invention:

(a) specific areas of the clothing are adapted to be reflective or non-reflective of said energy oppositely to the reflectivity or non-reflectivity of said material of the clothing;

(b) said specific areas of the clothing comprise a layer of a second material sewn or adhered to the surface of the material of the clothing;

(c) the second material is non-reflective and coloured black;

(d) the second material is reflective and coloured white;

(e) the specific areas of the clothing comprise a layer of pigment printed on the surface of the material of the clothing;

(f) the layer of pigment is non-reflective and coloured black;

(g) the layer of pigment is reflective and coloured white;

(h) the second material comprises felt.

In a further aspect of the invention, an interactive doll and clothing ensemble comprises a doll comprising multiple spaced magnetic sensors mounted near the surface of the doll at selected positions; articles of clothing comprising multiple spaced magnets adapted to come into registration with selected magnetic sensors when each article of clothing is separately placed on the doll; each article of clothing comprising a group of magnets corresponding to positions of selected magnetic sensors, such that the combination of number and positions of said magnets constitutes a unique code for each article of clothing; processing means adapted to receive sensor signals from the sensors and to generate a processor signal corresponding to the particular article of clothing worn by the doll; sound generation means adapted to receive the processor signal from the processing means and to generate one or more audible sounds appropriate to the particular article of clothing worn by the doll.

In further aspects of the invention:

(a) the processing means comprises a computer microprocessor;

(b) the sound generation means is adapted to generate sounds comprising artificial human speech;

(c) the sound generation means is adapted to generate a series of phrases;

(d) a selective registration magnet is always present on each article of clothing such that when the article of clothing is properly in place on the doll, the corresponding registration magnetic sensor on the doll generates a registration signal;

(e) no signals are generated by other magnetic sensors on the doll until triggered by a signal from the registration magnetic sensor;

(f) the processing means comprises a computer microprocessor, and the sound generation means is adapted to generate a series of phrases comprising artificial human speech;

(g) a registration opening on the doll or toy comprising a registration switch is adapted to receive a corresponding protrusion and/or peg on each article of clothing, such that when the article of clothing is properly in place on the doll or toy, the switch is triggered to generate or conduct a registration signal;

(h) no energy is generated by energy sources in sensors on the doll or toy until triggered by a signal generated by or conducted by the registration switch.

In a further aspect, the interactive doll and clothing ensemble comprises a doll comprising multiple spaced electromagnetic sensors mounted near the surface of the doll at selected positions, said electromagnetic sensors comprising pair of electromagnetic radiation generators and detectors; at least one magnetic sensor mounted near the surface of the doll at a selected position; articles of clothing comprising multiple spaced zones adapted to reflect electromagnetic radiation from an electromagnetic radiation generator to a corresponding detector, said zones adapted to come into registration with selected electromagnetic sensors when an article of clothing is placed on the doll; each article of clothing comprising a discrete group of zones corresponding to positions of selected sensors, such that the combination of number and positions of said zones constitutes a unique code for each article of clothing; said doll further comprising at least one magnetic sensor located at a selected location; each article of clothing comprising at least one magnet adapted to register with said magnetic sensor when the article of clothing is correctly in place; said magnetic sensor adapted to generate a registration signal to trigger the electromagnetic sensors to begin sensing; processing means adapted to receive signals from the magnetic sensor and from the electromagnetic sensors, to trigger the electromagnetic sensors to begin sensing, to process signals from the electromagnetic sensors to identify the particular article of clothing on the doll, and to send a processor signal to sound generation means; said sound generation means adapted to receive the processor signal and to generate one or more audible sounds appropriate to the particular article of clothing worn by the doll.

In a further aspect, an interactive doll and clothing ensemble comprises: a doll comprising multiple spaced electromagnetic sensors mounted near the surface of the doll at selected positions, said electromagnetic sensors comprising pairs of electromagnetic radiation generators and detectors powered by a source of energy; at least one master switch located on or in the doll at a selected position; articles of clothing comprising multiple spaced zones adapted to reflect electromagnetic radiation from an electromagnetic radiation generator to a corresponding detector, said zones adapted to come into registration with selected electromagnetic sensors when an article of clothing is placed on the doll; each article of clothing comprising a discrete group of zones corresponding to positions of selected sensors, such that the combination of number and positions of said zones constitutes a unique code for each article of clothing; each article of clothing comprising at least one master switch trigger adapted to register with said master switch when the article of clothing is placed on the doll; the master switch adapted to conduct power from the energy source to the electromagnetic sensors only when triggered by the placement of the article of clothing on the doll; processing means adapted to receive signals from the electromagnetic sensors to identify the particular article of clothing on the doll, and to send a processor signal to sound generation means; said sound generation means adapted to receive the processor signal and to generate one or more audible sounds appropriate to the particular article of clothing worn by the doll.

In a further aspect of the invention, multiple master switches are located in different positions on or in the doll and articles of clothing comprise master switch triggers adapted to register with one or more of said master switches when the article of clothing is placed on the doll.

In a further aspect, photointerrupter sensors are used. These sensors comprise pairs of energy emitting and energy detecting elements. The angle of emission of the radiation and the distance of the emitter from the detector may be chosen so as to generate signals when an article of clothing is placed within a certain range of distance from the sensors. Thus, if the clothing or any other reflective material is too far away, the emitted radiation will not be received by the detector and no recognition signal will be generated. A signal will be generated by detected radiation only when the clothing is placed in close proximity to the sensor, which proximity can be facilitated when the master switch trigger, which may comprise a shaped protrusion from the doll's clothing, is contacted with the master switch, preferably in an opening or receptacle corresponding to the shape of the protrusion, such that the article of clothing is located to the doll and the clothing is held close to the surface of the doll so as to generate a sensor signal. Fastening means on the clothing, such as matched pairs of Velcro™ strips, can be used to firmly position the clothing in final registration with the doll.

Further aspects of the invention will become apparent from the following description.

BRIEF DESCRIPTION OF THE DRAWINGS

The invention is illustrated by the following drawings in which.

DETAILED DESCRIPTION OF THE INVENTION

Figure 1:
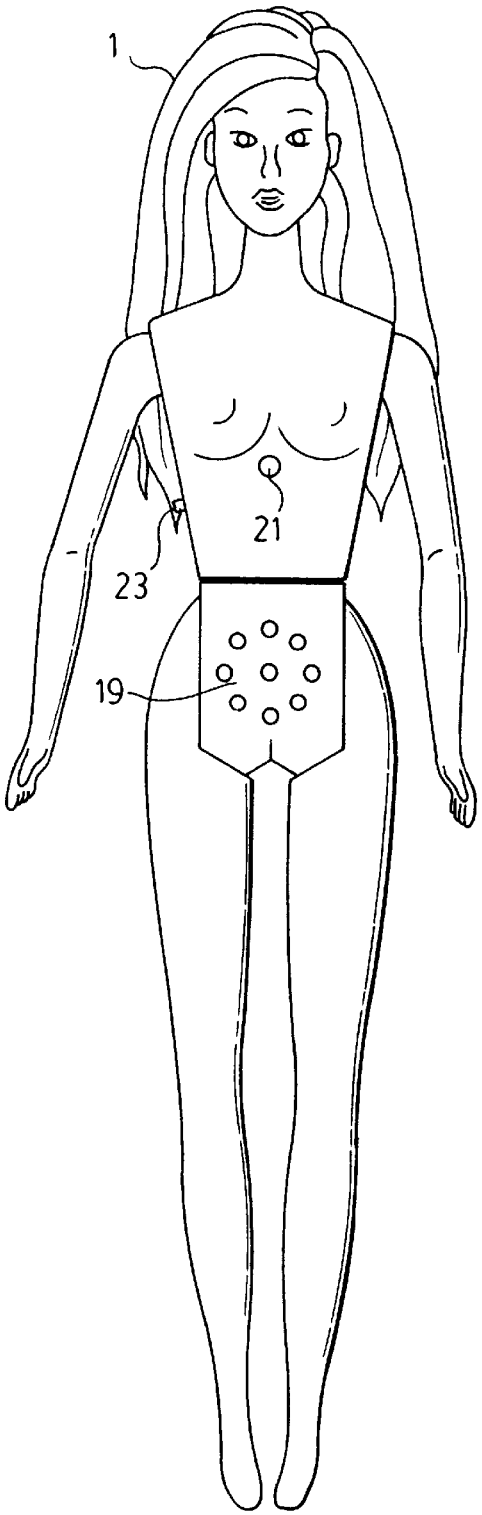
FIG. 1 is a frontal, schematic view of a doll.
Figure 2:
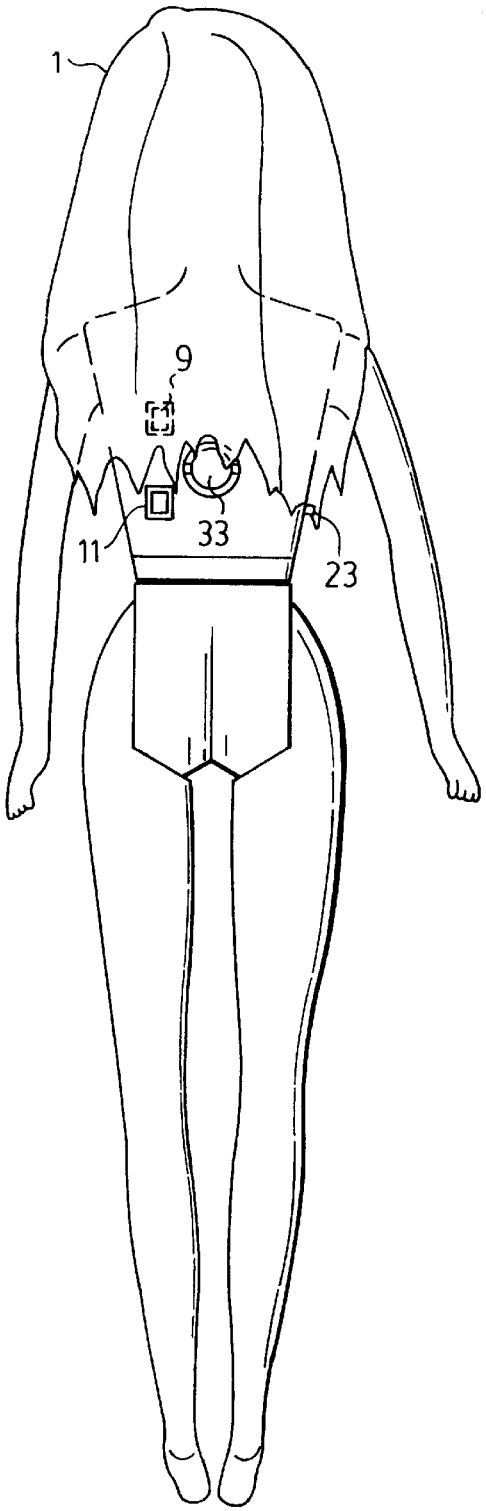
FIG. 2 is a rear, schematic view of a doll.

Referring to FIGS. 1 to 4, the interactive dress-up toy of the invention comprises a doll or toy 1 adapted to receive articles of clothing 3 or accessories 5 in certain positions. With respect to the articles of clothing, each contains certain areas 7 designed to reflect some form of electromagnetic energy 13 generated using a source of electrical energy (such as an electrical storage battery—not shown) mounted in the doll or toy. The electromagnetic energy emitted by a source 15, and received by a detector 17, can be chosen from any convenient frequency on the electromagnetic spectrum. Typically the generator of such energy and the detector thereof can be combined as a pair in a single sensor unit. Radio, infrared, visible or ultraviolet frequencies are all possible, although infrared radiation has proven to be a good, practical choice. Even magnetic field generators and detectors can comprise a suitable sensor if the clothing can be made to generate a magnetic field or to interfere with a magnetic field generated by the toy in an appropriate manner.

Each doll or toy can be provided with an array of sensors 9, 11 placed strategically at or near the surface of the doll or toy. The more sensors which are present the greater the possible number of combinations of such sensors will be. For example, if only a single sensor is present, it will provide either an "on" or "off" signal depending on whether a suitably reflective area of the clothing is placed in suitable proximity so as to generate a reflected signal. Thus, a single sensor could detect her clothing is on or off, but absent some other sensing means, could not differentiate between different articles of clothing. With two sensors, the combinations become off/off, on/off, off/on and on/on. Multiple sensors can be used to create sophisticated sensing capabilities to differentiate among multiple articles of clothing.

Figure 13:
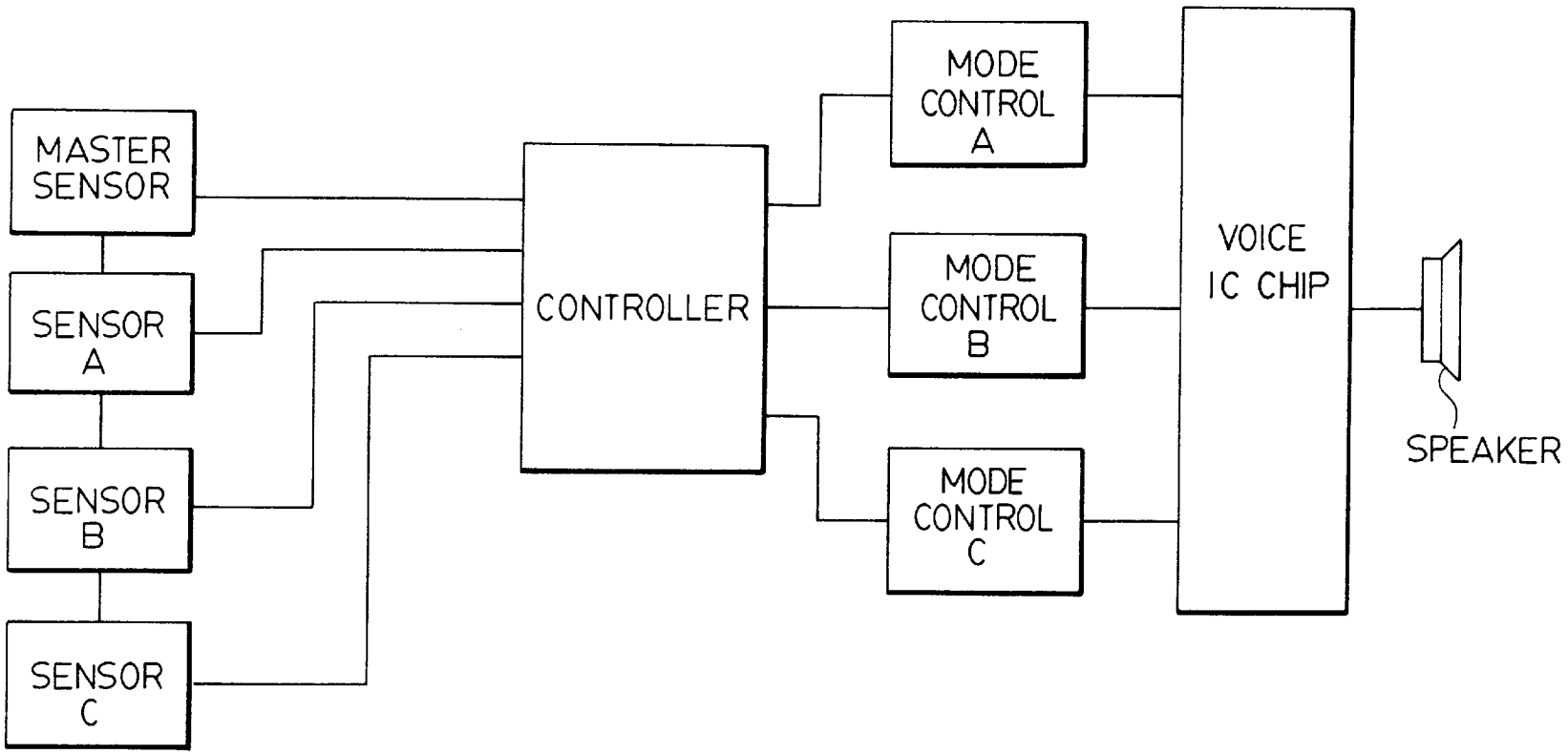
FIG. 13 is a schematic diagram showing an arrangement of sensors, controller, and sound generation means.
Figure 14:
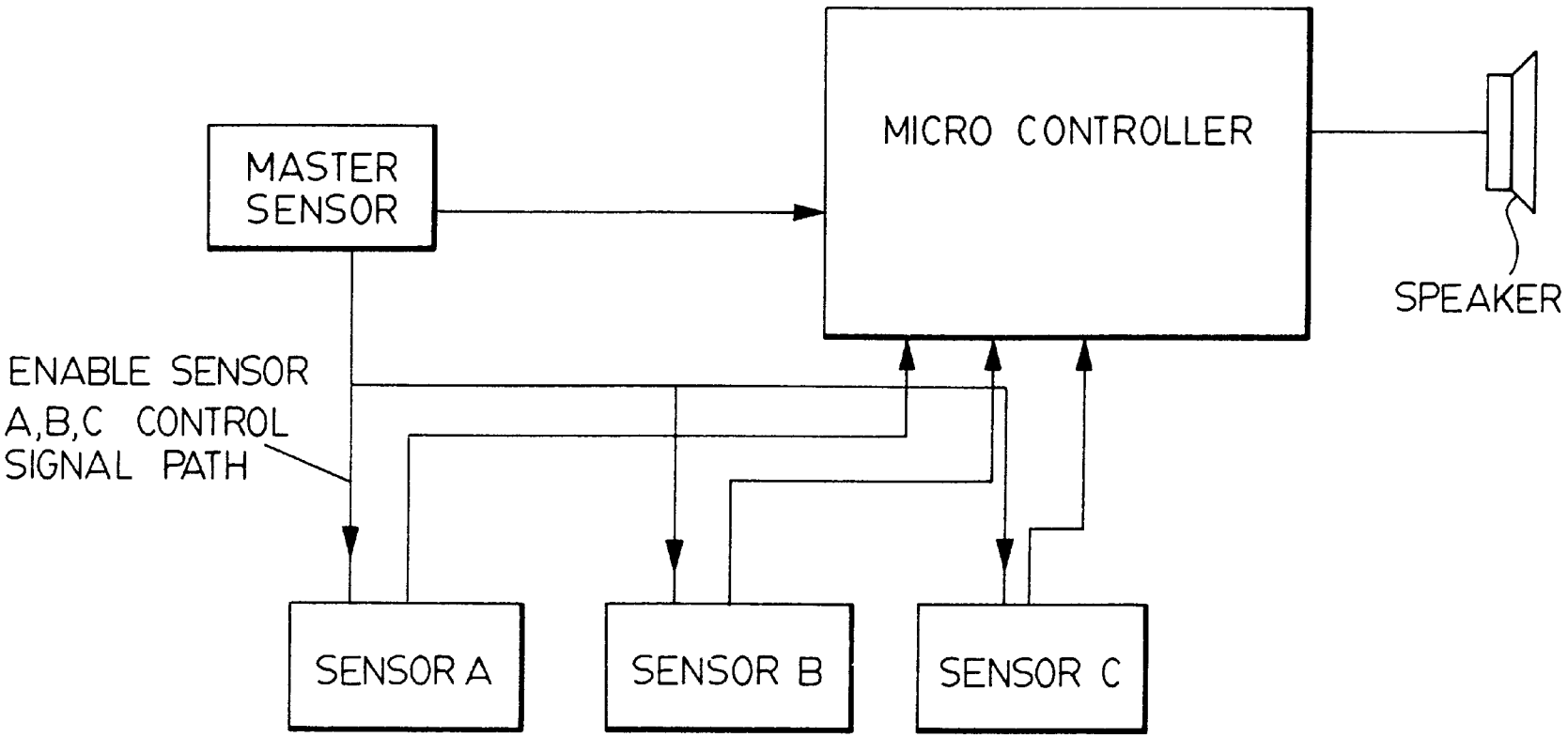
FIG. 14 is a schematic diagram showing an arrangement of master and secondary sensors.

When the clothing is appropriately placed on the doll, radiation from certain energy sources will reflect to corresponding detectors in a pattern specific to the article of clothing. Referring to FIGS. 13 and 14, the pattern of sensor data is then transmitted to a signal processor which compares the data to a preprogrammed set of responses. A set of responses comprising one or more audible or visual responses appropriate to the data, is then selected. The doll is then prompted through a controller to emit certain prerecorded sounds, such as simulated or artificial speech, to indicate that the article of clothing is correctly placed, or that the doll is pleased with the result, or that a certain activity should be undertaken. If the clothing has not been correctly placed, an alternative recording can be played to so indicate. The doll may be provided with an audio speaker 19 to generate sound. Alternatively, lights or display screens (not shown) can indicate whether an article of clothing is correctly placed, incorrectly placed, or missing entirely. The communication means may be triggered by a signal respecting the status of the clothing to produce audible signals appropriate to the status chosen from a set of signals appropriate to all possible clothing statuses. The status of the clothing may correspond to the presence or absence of a particular activity or personality and an appropriate set of audible responses. An additional mechanism, such as button 21, connected via a switch (not shown) to the processor, can be used to generate additional responses at the option of the user. A mode control switch 23 can be used to place the doll in the proper power mode, with power on or off or in some intermediate condition so that the toy will directly generate certain responses for testing in-store by customers, without providing battery power to the sensors.

Figure 6:
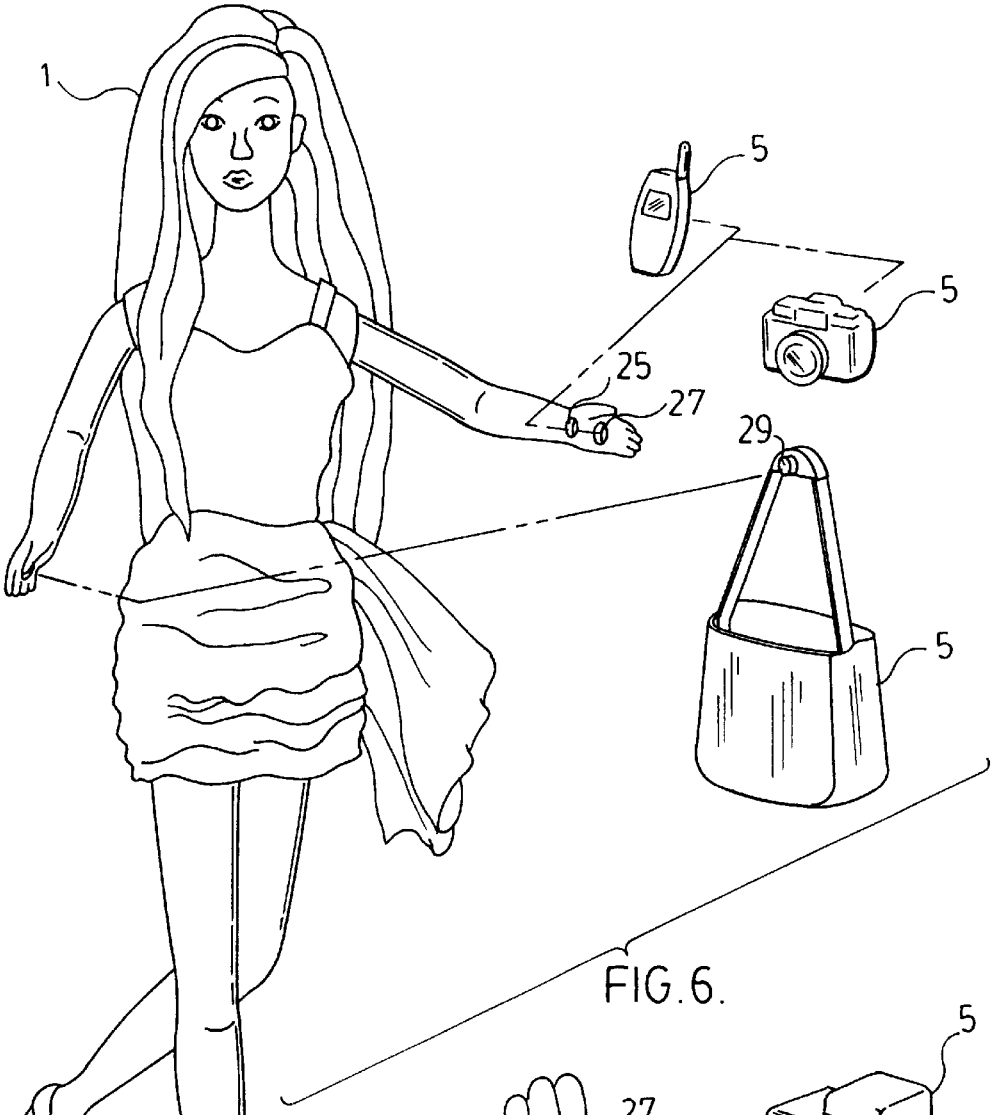
FIG. 6 is a schematic representation of the doll and accessories.
Figure 7:
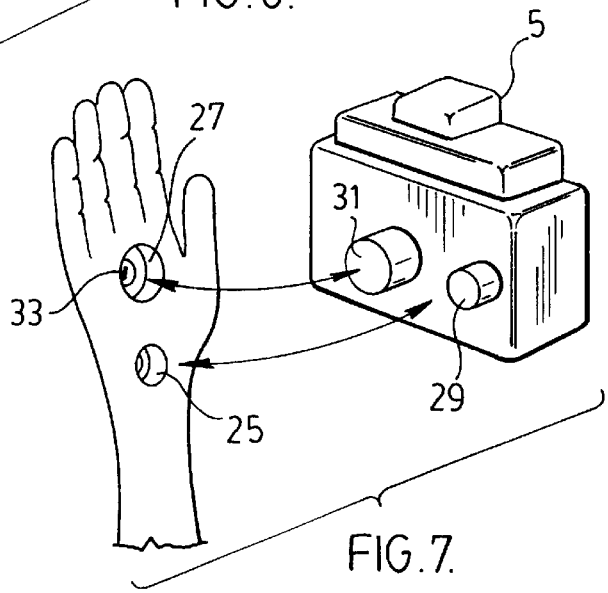
FIG. 7 is a schematic detail of a doll hand and an accessory.

With respect to the accessories, referring to FIGS. 6 and 7, the doll or toy can be provided with a series of holes or openings 25, 27 at various locations adapted to receive various accessories. By means of an array of long and short holes or openings, which will be filled or left empty in an unique way by corresponding pins or pegs 29, 31 on each different accessory, the doll can be programmed to recognize the particular accessory and whether it has been properly placed or located The same controller and sound recording, including simulated speech, can be used for this purpose. A typical arrangement of pins on accessories and holes or openings in the doll or toy will allow contact to be made between a pin and an electrical contact or switch 32 at the base of a short hole. Pins which fall into long holes make no contact while pins in short holes create a signal. As with the light sensors, the array of signals generated by the accessories sensors is unique to each particular accessory.

The status of an accessory triggers the communication means to produce audible signals appropriate to the status chosen from a set of signals appropriate to all possible accessories statues. The status of the accessory may correspond to the presence or absence of a particular activity or personality and an appropriate set of audible responses.

Figure 3:
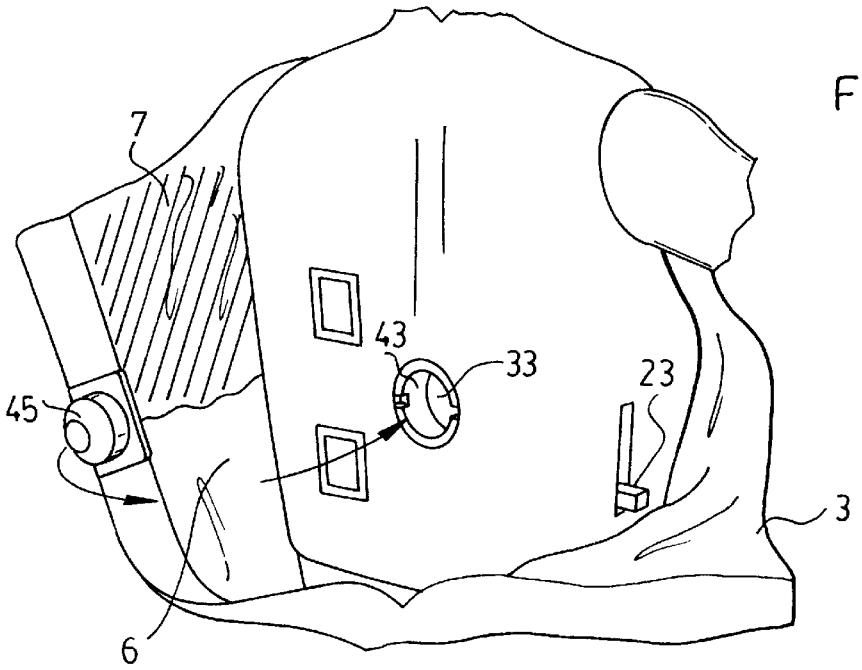
FIG. 3 is a perspective, schematic view illustrating unfastened clothing and a portion of the doll.
Figure 4:
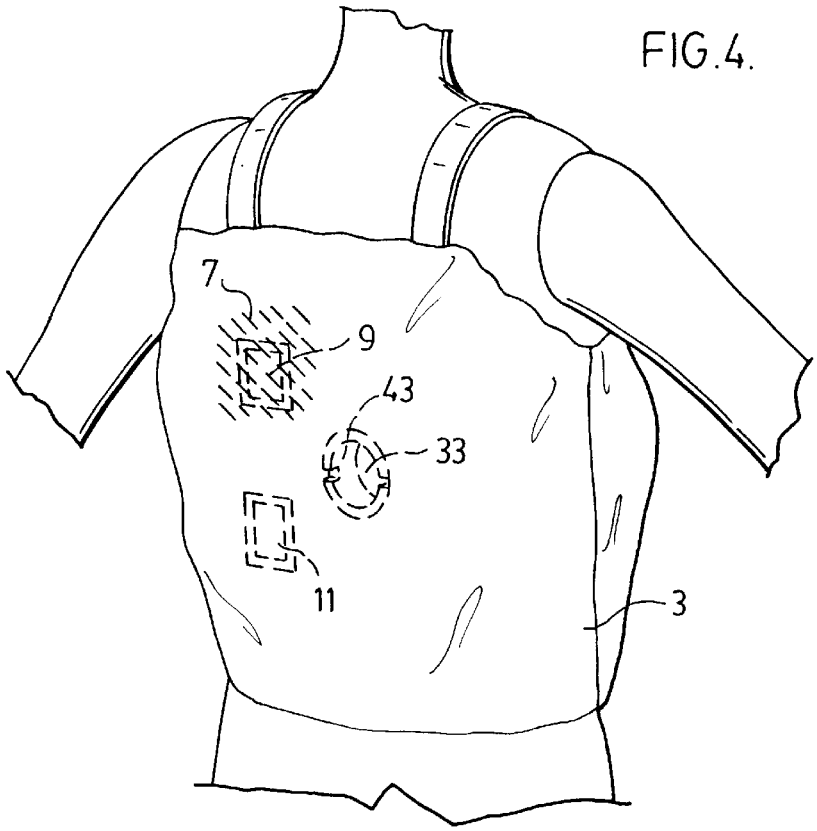
FIG. 4 is a perspective, schematic view, partially cut-away, illustrating fastened clothing and a portion of the doll.

In a preferred embodiment, referring to FIGS. 3 and 4, a master sensor 33, which may comprise a trigger switch, must be triggered by the placing of an article of clothing on the doll or toy before the secondary sensors 9, 11 are activated. Thus, electrical power is saved since sensors are only activated when needed.

Figure 5A:
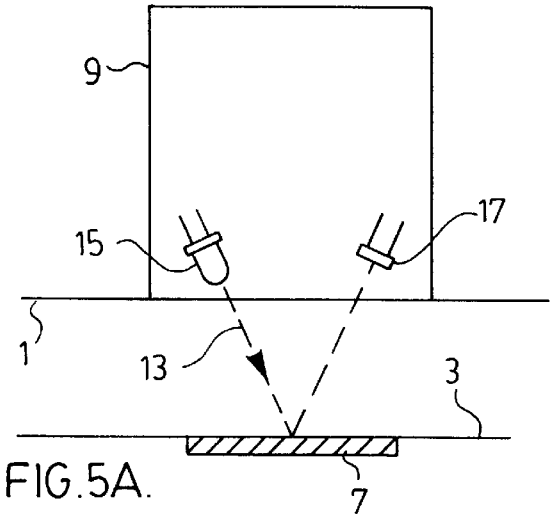
FIG. 5A is a schematic view of a sensor emitting and detecting radiation from a reflective surface.
Figure 5B:
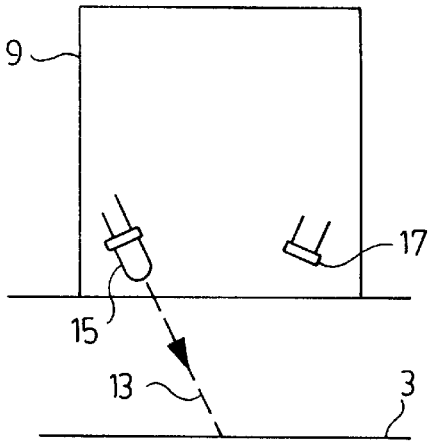
FIG. 5B is a schematic view of a sensor emitting radiation to a non-reflective surface.
Figure 5C:
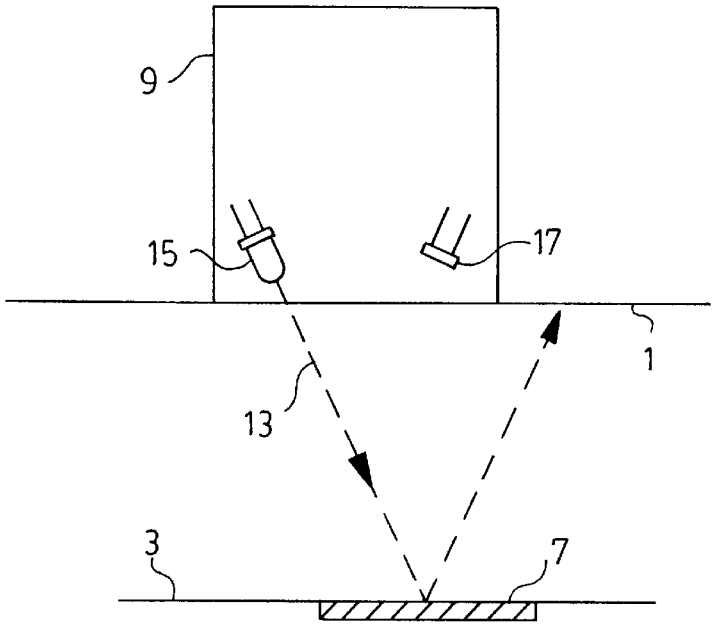
FIG. 5C is a schematic view of a sensor emitting radiation to a reflective surface not sufficiently adjacent the sensor for detection of the radiation.

In a preferred embodiment, referring to FIGS. 5A, 5B and 5C, the clothing sensors each comprise a light source 15 and a light detector 17 mounted close to the surface of the doll. The light source emits a beam 13 which is reflected by an appropriate reflective area 7 on each article of clothing, or not reflected if the reflective area is missing. Thus, with an array of such sensors, each individual item of clothing can be coded to permit identification.

Figure 8:
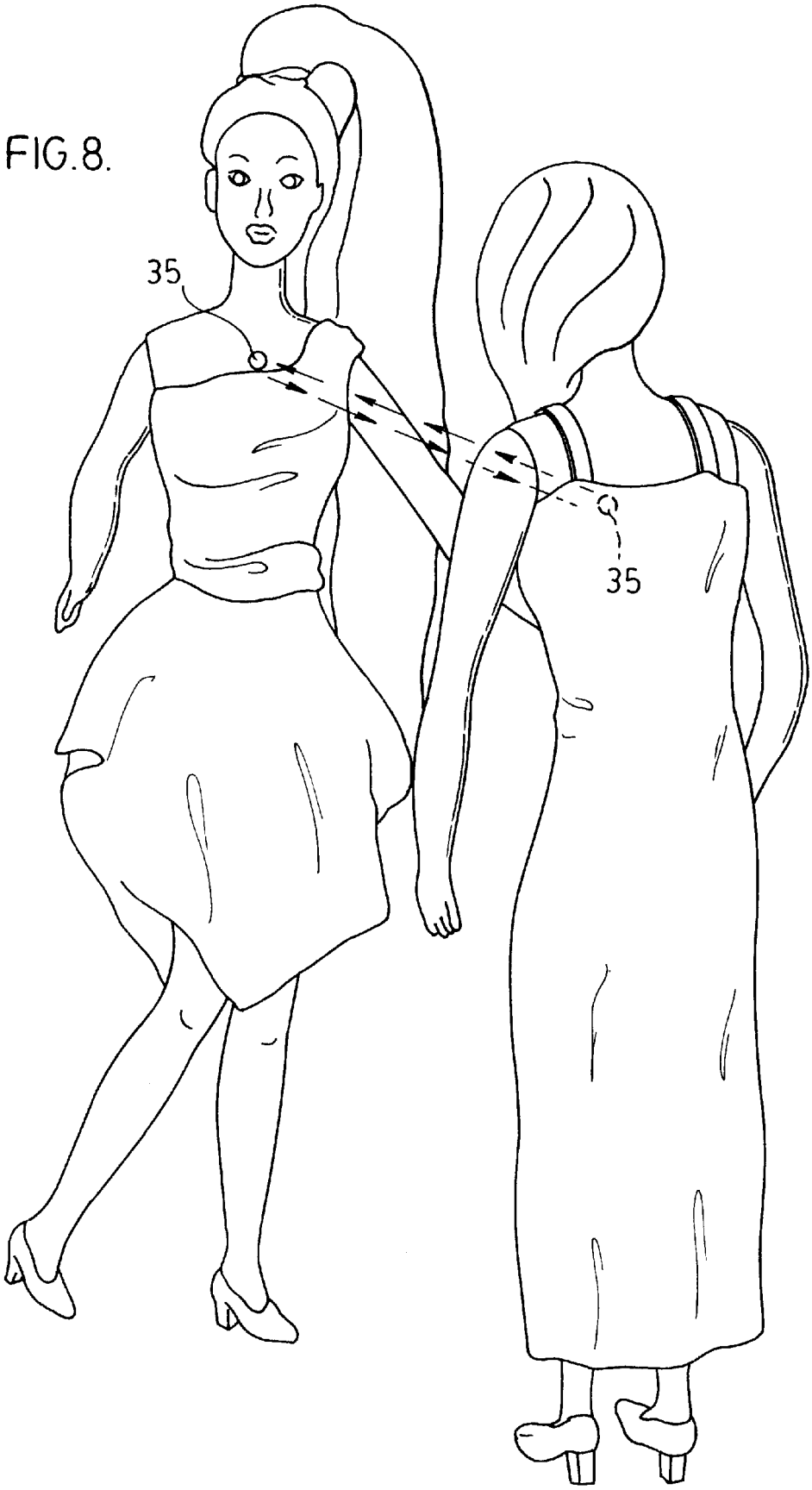
FIG. 8 is a schematic view of two dolls communicating data between themselves.

In an alternative embodiment, referring to FIG. 8, a multiplicity of dolls or toys each comprise transmission and/or receiving means 35 such that two dolls or toys can communicate their status one to the other, or back and forth to each other, and generate appropriate audible comments accordingly. Infrared transmitters and receivers have been found particularly useful in this regard. A signal received by a first doll from a second doll will contain information as to the identity of the second doll and the status of its clothing and/or accessories. The processor in the first doll which receives this signal from the receiving means will generate response or series of responses appropriate to said second doll's identity and status. When each doll is provided with a transmitter/receiver device, each doll can comment on the identity and status of the other. Typically the transmitter/receiver is mounted somewhere on the front side of each doll so that the dolls appear to be speaking face-to-face.

Referring to FIGS. 3 and 4, an article of clothing 3, such as a jacket or dress, comprises an inner surface 6 which is either a lining or the same material which also comprises the outer surface of the garment. This material may be chosen to be either reflective or non-reflective, depending upon the protocol chosen for reading a signal. Most preferably, the surface 6 will be non-reflective so that the lack of a signal from the sensor will not be seen as an important event by the pre-programmed doll or toy. An area 7 is designed to be reflective for the type of radiation chosen. Alternatively, this area can be non-reflective while the balance of the garment is reflective. The key is to have areas of the clothing which behave differently to a source of radiation, in terms of reflectivity. The area 7 can comprise a patch sewn or glued to the inner surface 6, or pigment printed on surface 6. Alternatively, area 7 can be a different lining material from that of surface 6; the colours of these areas can be different, or similar in order to disguise the function of area 7, or for aesthetic purposes, as long as area 7 reflects radiation while the balance of surface 6 does not reflect radiation back to the sensor.

By creating an array of reflective and non-reflective areas, the series of sensors can be coded to recognize different items of clothing 3 which will each have a unique pattern of reflective and non-reflective areas.

It is important that each article of clothing be adapted to be fastened into position on the dollar toy in a way that allows the doll to receive information to identify the article of clothing. In a preferred embodiment, referring to FIGS. 3 and 4, locating means comprise a cylindrical receptacle 43 in the back of the doll or toy into which a cylindrical member or protrusion 45 on each article of clothing can be placed. This ensures that the clothing is both anchored and properly oriented so that the correct reflective and non-reflective portions of clothing are located adjacent to the sensors. Additional fastening or closure means may be provided on the clothing so that the clothing can be snugly fitted to the doll or toy, as more fully described below.

Additionally, a trigger switch 33 located at the base of the cylindrical receptacle 43 can be tripped when the cylindrical member is fully inserted in the receptacle. The trigger switch can be used to help preserve battery life if the doll's or toy's power supply is derived from electrical storage batteries. In a preferred embodiment, no power is routed to the electromagnetic sensors 9, 11 until the trigger switch 33 is tripped Since the sensors use power continuously (or at least intermittently) when they scan for reflective signals, it may be important to ensure that such scanning does not commence until an article of clothing is placed on the doll or toy, if preserving battery power is important. When the article of clothing is removed, the switch will again be open, thus interrupting the flow of power. Since the clothing may be left on a doll or toy for long periods of time, a timer may be provided. If no activity takes place for a predetermine time in terms of movement of the doll or toy, or changes to its clothing or accessories, power to the sensors can be automatically cut off. This time function can be controlled by means of an integrated circuit (not shown).

Figure 12A:
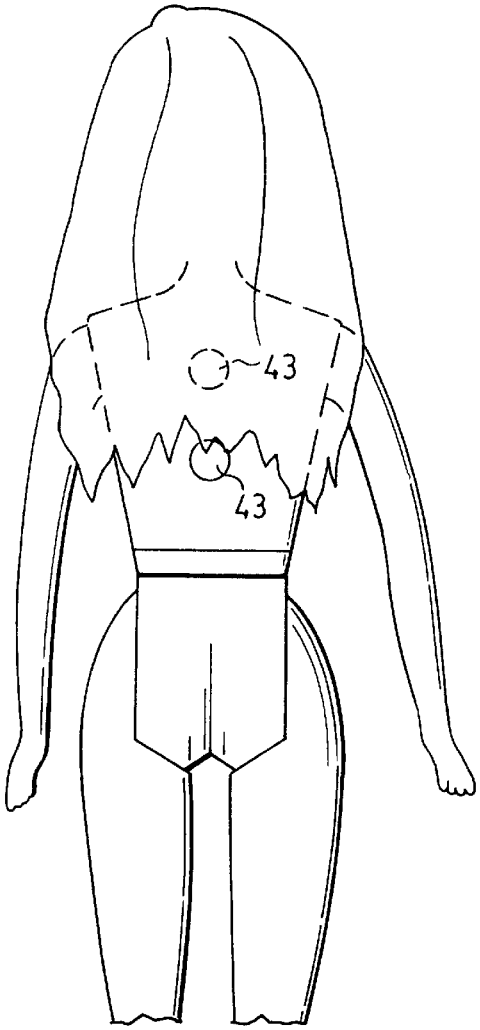
FIG. 12A is a rear, schematic view of a doll with multiple receptors.
Figure 12B:
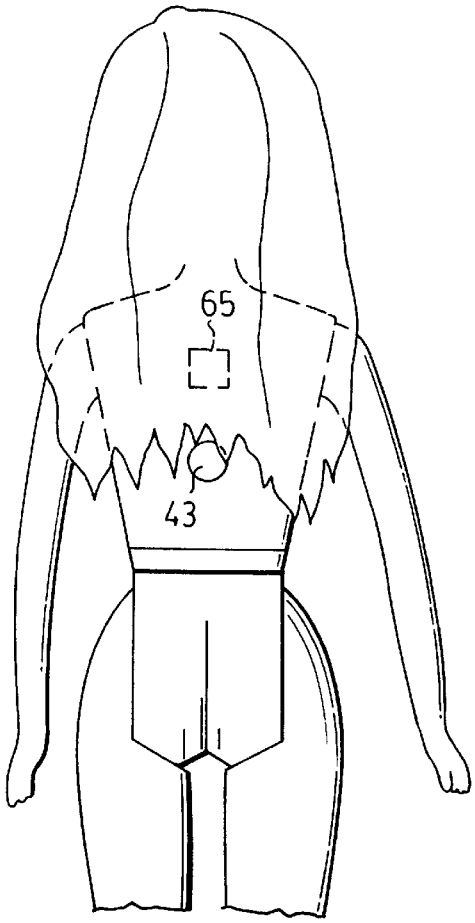
FIG. 12B is a rear, schematic view of a doll with differently-shaped multiple receptacles.

Additionally, referring to FIGS. 12A and 12B, multiple receptacles 43 may be provided to facilitate better anchoring of the clothing to the doll or to provide additional master switches. Such additional switches can be used to multiply the number of combinations of protrusions/cylindrical members and reflective areas which can be employed, or to indicate that the clothing is fully in place. In the latter case, a second receptacle 65 shaped differently from receptacle 43, can receive a second correspondingly-shaped protrusion adapted to act as fastening means and to produce a signal indicating that the clothing is fully in place.

Figure 9:
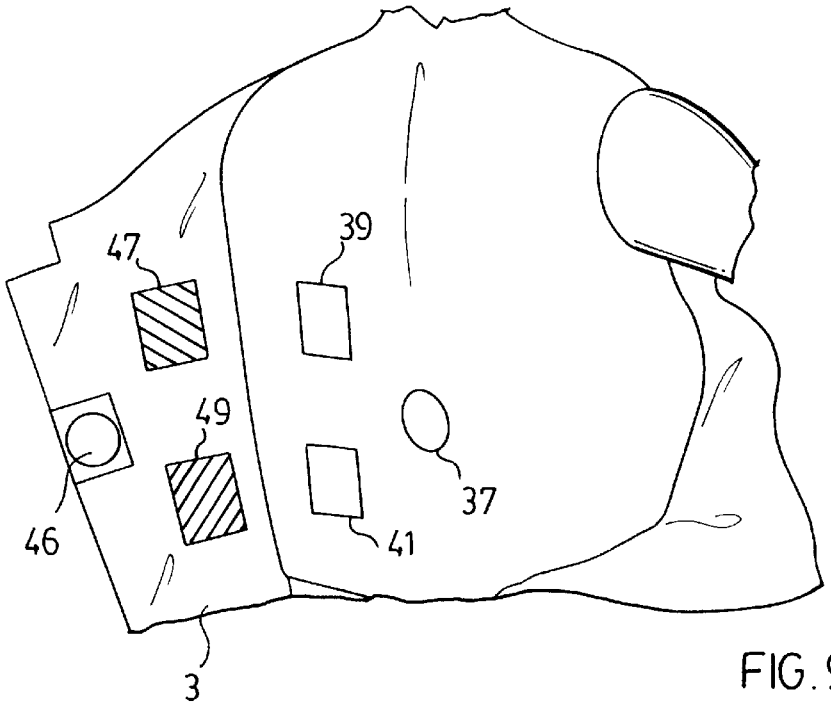
FIG. 9 is a schematic cut-away detail of a doll with a magnetic sensor and clothing with a corresponding magnet.

The same principle can be applied with the use of a trigger magnet on the clothing in place of a cylindrical member, and a magnetic sensor on the doll in place of a master switch Referring to FIG. 9, the doll comprises at least one mandatory magnetic sensor 37 and other multiple sensors 39, 41 which may be magnetic or electromagnetic (for example infrared) pairs of emitters and detectors. These secondary sensors 39, 41 may be located at various positions on the doll. The mandatory magnetic sensor 37 can be located at the back of the doll, the front of the doll, or some other convenient location. The magnetic sensor 37 should be located in a position on the doll or toy that is convenient to correspond with all of the articles of clothing which the doll is intended to wear, as further described below.

For example, an article of clothing 3 comprises a trigger magnet 46 and various other areas 47, 49 adapted to come into registration with the sensors 39, 41. If the sensors 39, 41 comprise magnetic sensors, then the areas 47, 49 will comprise magnets. If the sensors 39, 41 on the other hand, comprise other electromagnetic sensors, such as infrared sensors, then the areas 47, 49 can comprise patches or areas of material which can reflect infrared radiation from a source to a detector in each sensor. The presence or absence of an area 47, 49 will determine whether each particular sensor generates a signal or not. By selecting combinations of areas 47, 49 to correspond with sensors 39, 41, a unique code can be created for each article of clothing. Obviously, the greater the number of sensors 39, 41, the greater the number of combinations will be possible. Thus, a larger number of sensors will enable the doll to recognize more articles of clothing since more codes for such clothing will be available.

In operation, once the clothing is placed securely on the doll, the trigger magnet 46 will be in registration with the sensor 37. After a suitable registration signal is generated by sensor 37, the other sensors 39, 41 will be triggered to begin sensing. The use of the trigger magnet 46 is helpful to preserve electrical power. If a particular signal is required to begin the flow of electrical power to the other sensors 39, 41, precious battery power will be preserved.

Figure 10:
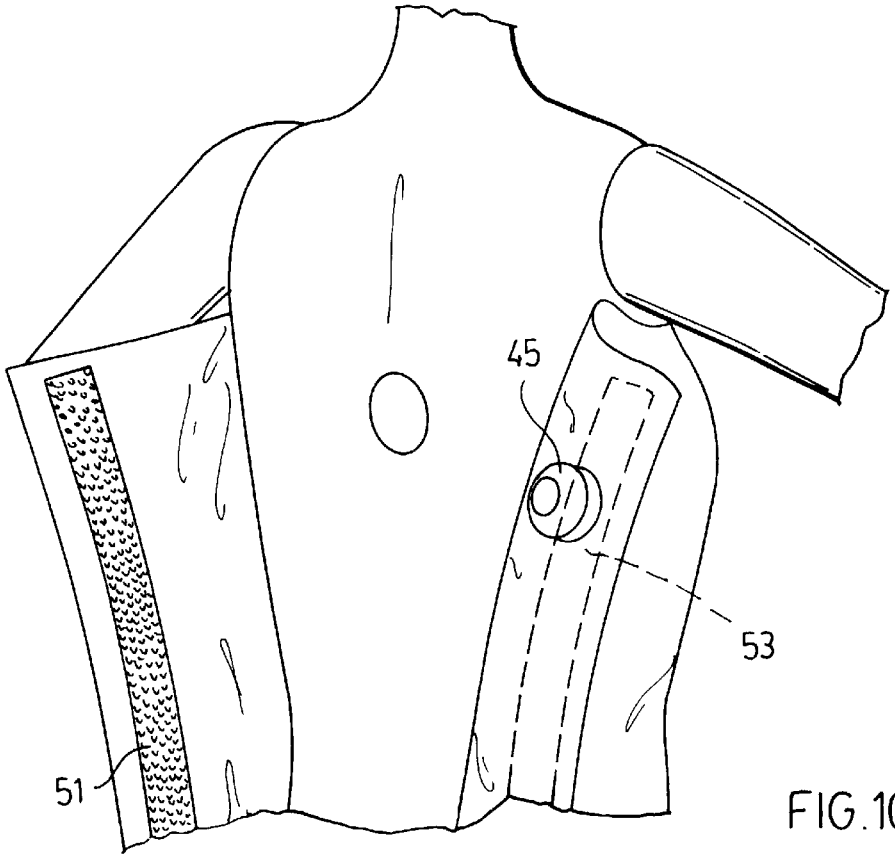
FIG. 10 is a schematic representation of Velcro™ closure means for the clothing.
Figure 11A:
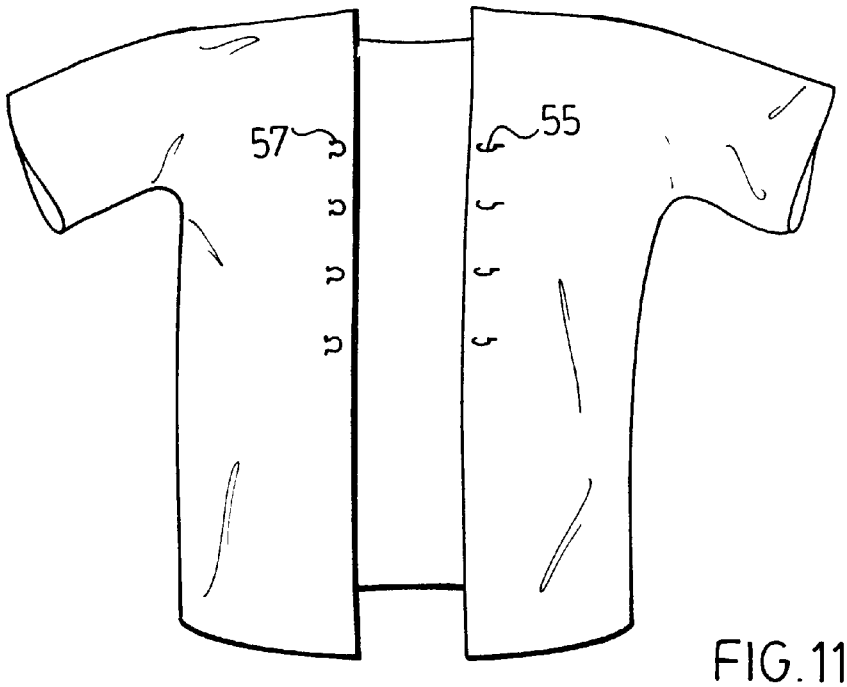
FIG. 11A is a schematic representation of hook and eye closure means for the clothing.
Figure 11B:
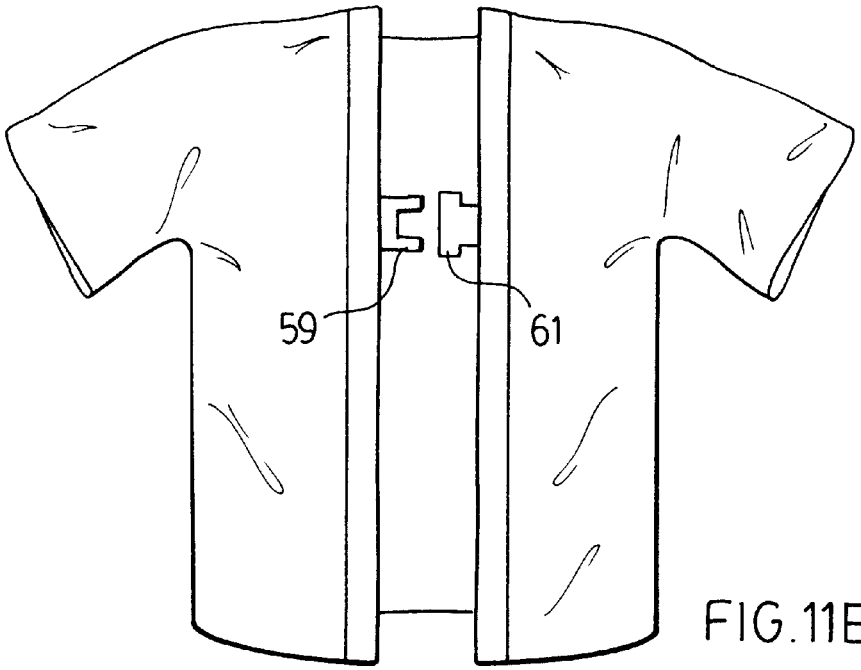
FIG. 11B is a schematic representation of male/female clip closure means for the clothing.

The articles of clothing should be adapted to be fastened in a fairly uniform manner so that the trigger magnet 46 and the other areas 47, 49 will always come into fairly close registration with sensors 37 and 39, 41 respectively. One means to achieve such reproducibility is to provide closure means on each article of clothing, as previously mentioned. When the closure means are fastened snugly, the article of clothing will be in a predictable and reproducible position. Examples of suitable closure means are corresponding adhesive strips 51, 53 or patches, which could comprise some sort of mastics or mechanical adhesion such as Velro™ material as illustrated in FIG. 10, a hook 55 and eye 57 arrangement as illustrated in FIG. 11A, or a male clip 59 and female type clip 61 arrangement, as illustrated in FIG. 11B.

When a set of signals is received from a group of sensors by processing means, the particular code will be identified and a set of signals will be generated to create a doll activity appropriate to the article of clothing chosen. A processor signal corresponding to the particular article of clothing worn by the doll will be generated. Sound generation means will receive the processor signal and generate one or more audible sounds appropriate to the particular article of clothing worn by the doll.

Typically, the processing means will comprise a computer microprocessor which may be located on an integrated circuit chip. The sound generation means may be adapted to generate sounds comprising artificial human speech. Thus, the doll can generate a phrase of simulated human speech which will indicate whether or not a correct article of clothing has been chosen for a certain activity, or provide comments respecting the particular activity chosen, as appropriate.

It should be noted that although the presence of a registration magnet or a protrusion on each article of clothing with a corresponding magnetic sensor or receptacle with a trigger switch, respectively, is of great benefit in saving battery life, this feature is not essential to the working of the invention. The registration of the various sensors with the articles of clothing is the key feature.

Although a preferred embodiment of the invention has been described, modifications of this embodiment will be apparent to those skilled in the art. The invention is not intended to be limited to the preferred embodiment and such modifications are within the scope of the invention.

What is claimed is:

1. An interactive doll and clothing ensemble comprising:

(a) a doll comprising multiple spaced magnetic sensors mounted near the surface of the doll at selected positions;

(b) articles of clothing comprising multiple spaced magnets adapted to come into registration with selected magnetic sensors when each article of clothing is separately placed on the doll;

(c) each article of clothing comprising a group of magnets corresponding to positions of selected magnetic sensors, such that the combination of number and positions of said magnets constitutes a unique code for each article of clothing;

(d) possessing means adapted to receive sensor signals from the sensors and to generate a processor signal corresponding to the particular article of clothing worn by the doll;

(e) sound generation means adapted to receive the processor signal from the processing means and to generate one or more audible sounds appropriate to the particular article of clothing worn by the doll.

2. The interactive doll and clothing ensemble of claim 1, wherein the processing means comprises a computer microprocessor.

3. The interactive doll and clothing ensemble of claim 1, wherein the sound generation means is adapted to generate sounds comprising artificial human speech.

4. The interactive doll and clothing ensemble of claim 3, wherein the sound generation means is adapted to generate a series of phrases.

5. The interactive doll and clothing ensemble of claim 3, wherein a selected registration magnet is always present on each article of clothing such that when the article of clothing is properly in place on the doll, the corresponding registration magnetic sensor on the doll generates a registration signal.

6. The interactive doll and clothing ensemble of claim 5, wherein no signals are generated by other magnetic sensors on the doll until triggered by a signal from the registration magnetic sensor.

7. The interactive doll and clothing ensemble of claim 6, wherein the processing means comprises a computer microprocessor, and the sound generation means is adapted to generate a series of phrases comprising artificial human speech.

8. An interactive doll and clothing ensemble comprising:

(a) a doll comprising multiple spaced electromagnetic sensors mounted near the surface of the doll at selected positions, said electromagnetic sensors comprising pairs of electromagnetic radiation generators and detectors;

(b) at least one magnetic sensor mounted near the surface of the doll at a selected position;

(c) articles of clothing comprising multiple spaced zones adapted to reflect electromagnetic radiation from an electromagnetic radiation generator to a corresponding detector, said zones adapted to come into registration with selected electromagnetic sensors when an article of clothing is placed on the doll;

(d) each article of clothing comprising a discrete group of zones corresponding to positions of selected sensors, such that the combination of number and positions of said zones constitutes a unique code for each article of clothing;

(e) each article of clothing comprising at least one magnet adapted to register with said magnetic sensor when the article of clothing is correctly in place;

(f) said magnetic sensor adapted to generate a registration signal to trigger the electromagnetic sensors to begin sensing;

(g) processing means adapted to receive signals from the magnetic sensor and from the electromagnetic sensors, to trigger the electromagnetic sensors to begin sensing, to process signals from the electromagnetic sensors to identify the particular article of clothing on the doll, and to send a processor signal to sound generation means;

(h) said sound generation means adapted to receive the processor signal and to generate one or more audible sounds appropriate to the particular article of clothing worn by the doll.

9. An interactive doll and clothing ensemble comprising:

(a) a doll comprising multiple spaced electromagnetic sensors mounted near the surface of the doll at selected positions, said electromagnetic sensors comprising pairs of electromagnetic radiation generators and detectors powered by a source of energy.

(b) at least one master switch located on or in the doll at a selected position;

(c) articles of clothing comprising multiple spaced zones adapted to reflect electromagnetic radiation from an electromagnetic radiation generator to a corresponding detector, said zones adapted to come into registration with selected electromagnetic sensors when an article of clothing is placed on the doll;

(d) each article of clothing comprising a discrete group of zones corresponding to positions of selected sensors, such that the combination of number and positions of said zones constitutes a unique code for each article of clothing;

(e) each article of clothing comprising at least one master switch trigger adapted to register with said master switch when the article of clothing is placed on the doll;

(f) the master switch adapted to conduct power from the energy source to the electromagnetic sensors only when triggered by the placement of the article of clothing on the doll;

(g) processing means adapted to receive signals from the electromagnetic sensors to identify the particular article of clothing on the doll, and to send a processor signal to sound generation means;

(h) said sound means adapted to receive the processor signal and to generate one or more audible sounds appropriate to the particular article of clothing worn by the doll.

10. The interactive doll and clothing ensemble of claim 9, wherein the doll comprises multiple master switches located at different selected positions on or in the doll adapted to be triggered by one or more master switch triggers on each article of clothing.

* * * * *